US007770234B2

(12) United States Patent
Roux et al.

(10) Patent No.: US 7,770,234 B2
(45) Date of Patent: Aug. 10, 2010

(54) SPORTS GARMENT

(75) Inventors: Isabelle Roux, Metz-Tessy (FR); Pascal Lenormand, Veyrier du lac (FR); Catherine Fellouhe, Seynod (FR); John Joseph Collier, New York, NY (US); Markus Rindle, Chene Bougeries (CH)

(73) Assignee: Salomon S.A.S., Metz-Tessy (FR)

( * ) Notice: Subject to any disclaimer, the term of this patent is extended or adjusted under 35 U.S.C. 154(b) by 1329 days.

(21) Appl. No.: 10/885,068

(22) Filed: Jul. 7, 2004

(65) Prior Publication Data

US 2005/0015843 A1 Jan. 27, 2005

(30) Foreign Application Priority Data

Jul. 8, 2003 (FR) ..... 03 08310

(51) Int. Cl.
*A41D 13/00* (2006.01)

(52) U.S. Cl. ..... 2/69

(58) Field of Classification Search ..... 2/94, 2/69, 102, 108, 124, 125, 101, 119
See application file for complete search history.

(56) References Cited

U.S. PATENT DOCUMENTS

| | | | | |
|---|---|---|---|---|
| 2,952,022 | A | 9/1960 | Blauer | |
| 3,777,309 | A * | 12/1973 | Yeager | 2/2.5 |
| 4,320,538 | A * | 3/1982 | Saft | 2/102 |
| 4,470,155 | A | 9/1984 | Maeshima | |
| 4,554,682 | A | 11/1985 | Hillquist | |
| 5,088,116 | A | 2/1992 | Gould | |
| 5,860,163 | A | 1/1999 | Aldridge | |
| 6,263,511 | B1 * | 7/2001 | Moretti | 2/97 |
| 7,028,342 | B1 * | 4/2006 | Nordstrom et al. | 2/119 |
| 7,117,539 | B1 | 10/2006 | Baacke | |

FOREIGN PATENT DOCUMENTS

FR 2 557 435 A1 7/1985

* cited by examiner

*Primary Examiner*—Tejash Patel
(74) *Attorney, Agent, or Firm*—Greenblum & Bernstein, P.L.C.

(57) ABSTRACT

A garment for protecting at least the upper portion of the body. The garment includes a sleeveless vest to cover the torso and made of a thermally insulating and ventilated material, and a short jacket with sleeves, such as a bolero-type jacket, covering only the upper portion of the torso and made of an impermeable material.

30 Claims, 4 Drawing Sheets

SPORTS GARMENT

CROSS-REFERENCE TO RELATED APPLICATION

This application is based upon French Patent Application No. 03.08310, filed Jul. 8, 2003, the disclosure of which is hereby incorporated by reference thereto in its entirety and the priority of which is hereby claimed under 35 U.S.C. §119.

BACKGROUND OF THE INVENTION

1. Field of the Invention

The invention relates to a protective bust garment for sporting activities, and particularly for running.

2. Description of Background and Relevant Information

Running is an activity that implies a substantial physical exertion and release of perspiration, particularly in the area of the bust. Generally, those who practice the activity frequently do so while wearing a mere T-shirt.

When this activity is practiced in low temperatures, on the order of 0-10° C., or in the rain, an additional protection is nonetheless necessary against the cold and/or wetness.

To overcome this problem, one of two different types of garments are known to be used.

First, the runner can wear an insulating garment made, for instance, of a light fleece, a garment with a windbreaker membrane, etc. Such garments have the main object of providing a thermal insulation, and possibly a certain breathability, i.e., an evacuation of perspiration. However, such garments are not impermeable and consequently cannot offer protection against rain, Second, there are protective garments that are specifically designed for rain which are either completely impermeable (coated fabric), or so-called "breathable-impermeable" (having a so-called breathable-impermeable membrane, i.e., impermeable to water but allowing water vapor to pass through). Due to the substantial physical exertion that is expended when engaging in the sport, these protective garments quickly become uncomfortable due to the condensation that is produced, since even the so-called breathable-impermeable membranes are not sufficiently breathable to evacuate all, or substantially all, of the moisture produced.

There has also been proposed a running jacket having back and front portions made of a ventilated material, with the sleeves, shoulders and sides of the jacket being made of an impermeable material. The sleeves are detachable so that they can be removed when it is not raining. In this case, the jacket is transformed into a vest allowing for a better breathability, The drawback to this type of jacket is that once it is transformed into a vest, the latter conserves impermeable portions in the zones in which perspiration is substantial, particularly the shoulders and sides of the vest. Consequently, there is insufficient ventilation and the vest is uncomfortable to wear in dry weather.

Furthermore, in this known vest, the upper part of the back located between the shoulders has non-impermeable portions, such that, in rainy weather, water can infiltrate into this zone that is particularly exposed to rain.

SUMMARY OF INVENTION

An object of the present invention is to overcome the aforementioned drawbacks and, in particular, to provide a new type of garment that is pleasant to wear when running in cold weather as much as in rainy weather.

This object is achieved by the garment according to the invention in that it includes a sleeveless vest covering the torso and made of a thermally insulating and ventilated material, i.e., air permeable, and a short jacket with sleeves, of the bolero-type, covering only the upper portion of the torso and made of a material that resists water penetration and/or is impermeable.

Thus, the vest no longer has impermeable portions that can hinder its breathability and, as for the bolero-type jacket, it is completely impermeable or resistant to water penetration and covers the top of the shoulders and torso. In this manner, it offers a better protection against rain and does not create a weak zone into which water could infiltrate.

BRIEF DESCRIPTION OF DRAWINGS

The invention will be better understood and other characteristics thereof will become apparent from the following description given with reference to the attached schematic drawings showing, by way of non-limiting examples, a preferred embodiment, and in which.

DETAILED DESCRIPTION OF THE INVENTION

Figure 1:
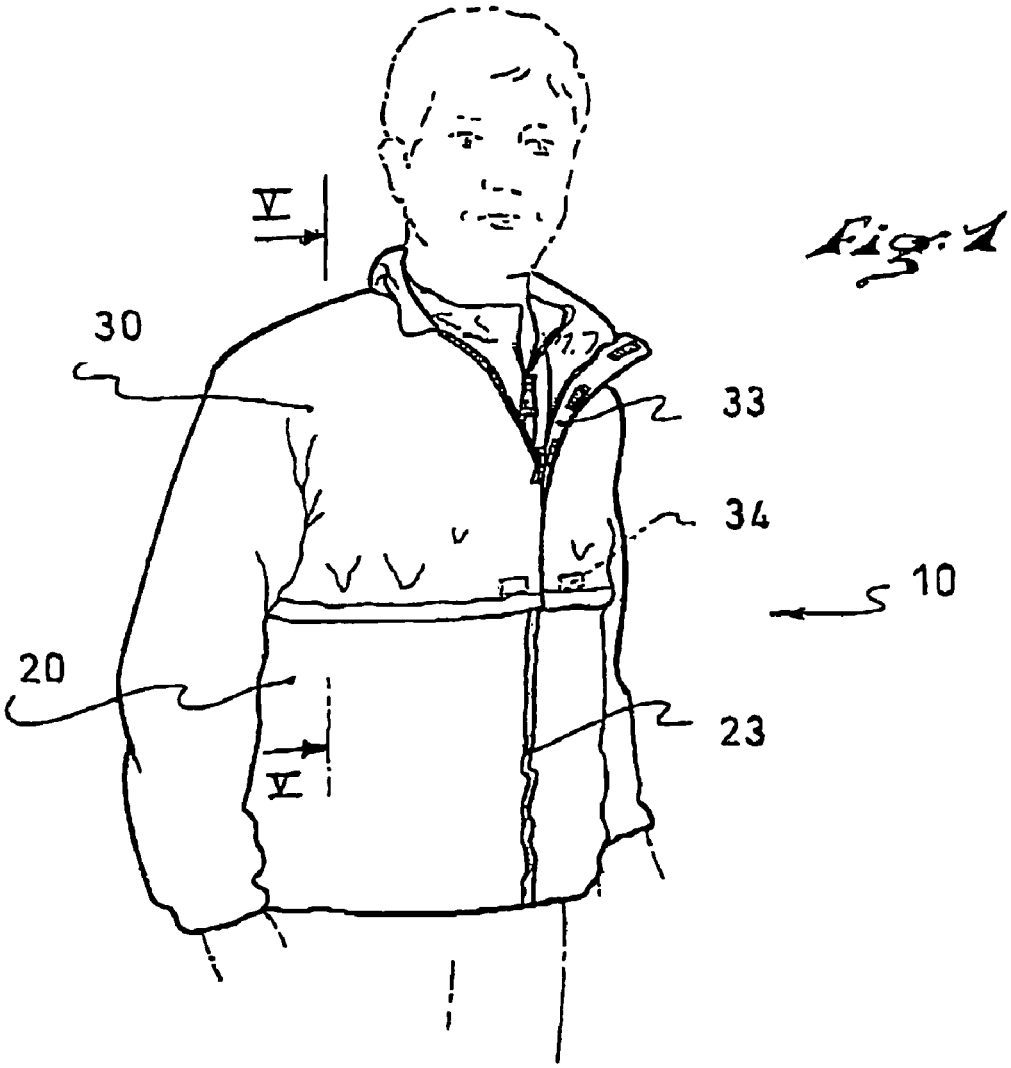
FIG. 1 is a perspective three-quarter front view of the protective garment according to the invention.
Figure 2:
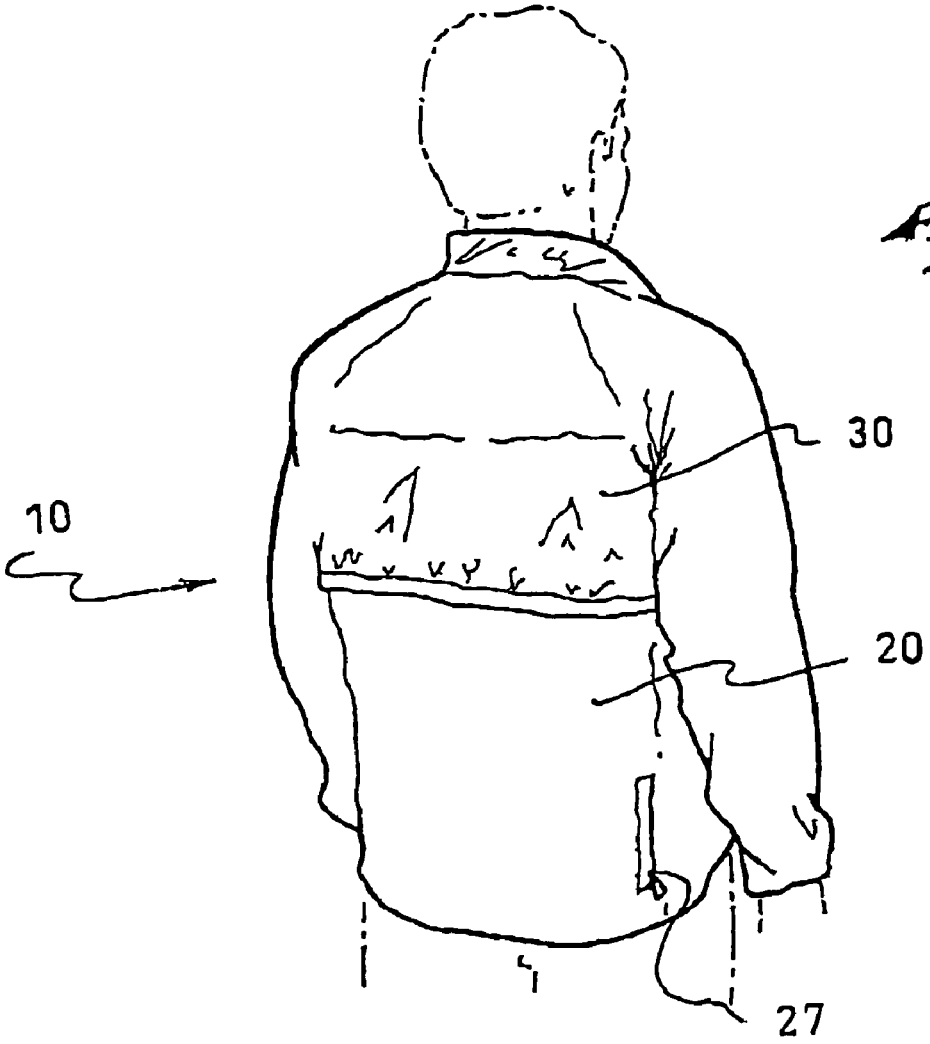
FIG. 2 is a three-quarter rear view similar to FIG. 1.
Figure 3:
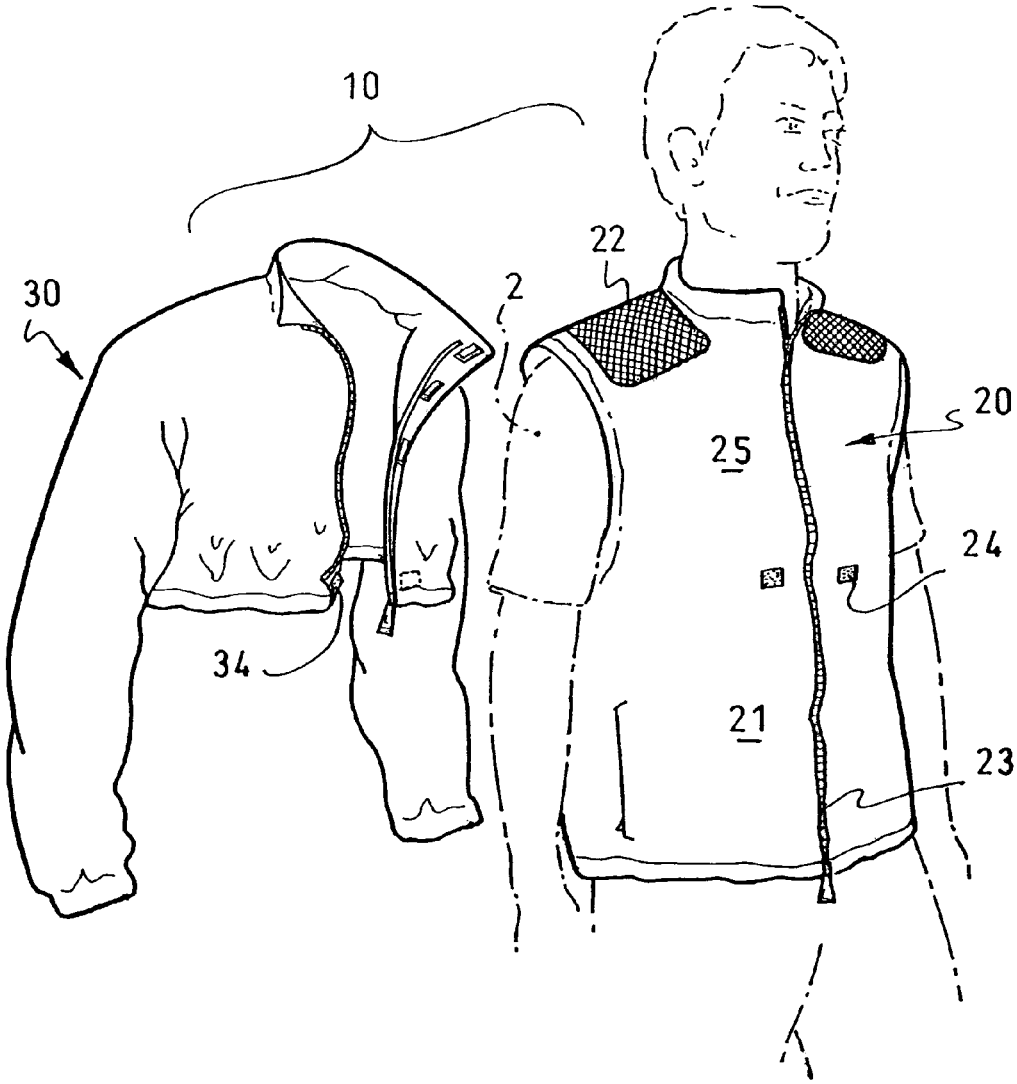
FIG. 3 is a perspective view of the garment before assembly.

As shown particularly in FIGS. 1-3, the protective garment 10 according to the invention includes a sleeveless vest 20 covering the torso, and a short jacket 30 with long sleeves, of the bolero-type. As the case may be, the sleeves of the short-waisted jacket 30 could also be short or semi-long (three-quarter length, for example).

Figure 4:
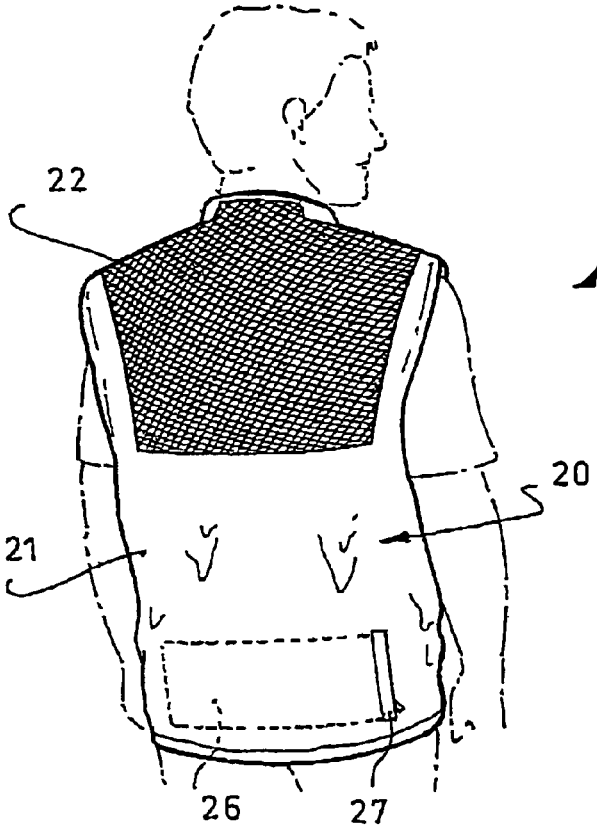
FIG. 4 is a rear view of the vest of the garment.

As shown in FIGS. 3 and 4, the vest 20 is comprised of at least two different materials.

Over the majority of its front and rear portions, the vest 20 has a thermally insulating fabric 21 for the 0-10° C. temperature range considered, but which is ventilated, meaning air permeable.

It can be an extensible material such as polyester, polyamide, or a combination, laminated to a jersey.

Depending on the material from which the jersey is made, the role of the jersey can be to capture moisture originating from the T-shirt or singlet 2 worn underneath and to evacuate it to the outside. The double layer of extensible material/jersey (such as polyester/jersey) gives the desired freedom of movement while remaining air permeable, and provides a sufficient windbreaker effect to avoid any excessive cooling.

The materials of this first zone of the vest can be different depending upon the temperature range for which thermal insulation is desired and/or resistance to wind/ventilation is desired.

It can also be a material such as the commercially known WINDSTOPPER® that prevents wind from passing through while remaining "breathable," i.e., letting water vapor pass, and warm. It can also be a so-called WINDSTOPPER® material having no particular thermal insulation.

On the top of the shoulders and upper back, the vest 20 preferably has a zone 22 made of a so-called three-dimensional material. For the exemplary embodiment, FIG. 3 shows the three-dimensional material of zone 22 extending slightly downwardly on left and right sides, i.e., on either side of the wearer's neck, from the top of the shoulders. FIG. 3 also shows that the three-dimensional material of zone 22 does not necessarily extend throughout the entire width of the front or rear portions of the vest.

The function of the three-dimensional material is:

- to be very ventilated when the vest is used alone, which allows remaining "cool" (in the condition of the most extreme heat);
- to maintain a certain thickness, and therefore a thermal insulation preventing cooling through the shoulders when the bolero-type jacket is worn over the vest (in the condition of the most extreme cold);
- to prevent the impermeable material of the bolero-type jacket from "sticking" and thereby providing an unpleasant feeling of moisture.

Figure 5:
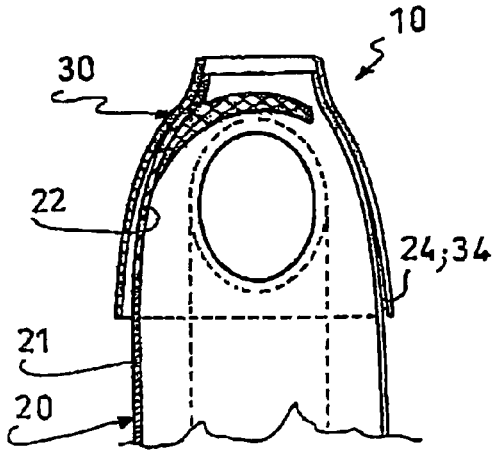
FIG. 5 is a partial cross-sectional view along line V-V of FIG. 1.

As shown in FIG. 4, the three-dimensional material zone 22 has a lower rear edge spaced above the lower edge of the rear portion of the vest 20 and, as shown in FIGS. 3 and 5, the three-dimensional zone 22 extends upwardly over the wearer's upper back through the tops of the left and right shoulders of the vest In fact, FIGS. 3 and 5 show that the three-dimensional zone 22, for each of the left and right shoulders of the vest extend slightly downwardly from the tops of the shoulders to lower edges. Further, as can be seen by comparing the rear views of FIGS. 2 and 4, the rear of the three-dimensional zone 22 extends throughout a majority of, and substantially the entirety of, the region of the back of the jacket 30, the rear of the three-dimensional zone 22 extending downwardly to proximate the lower edge of the jacket 30.

The vest 20 has no sleeves. Accordingly, its role is solely to provide thermal protection of the bust/torso in dry weather, without hindering arm movement.

At the front, the vest 20 is provided with an opening that can be closed by means of a closure 23, which can take the form of a slide-fastener mechanism, such as a zipper, or a self-gripping mechanism (hook-and-loop fasteners), such as Velcro®, etc.

The vest also has two fastening elements 24 of the self-gripping-type, or snap buttons, etc., on each side of its opening 23, in the lower limit of its zone 25 covering the chest. Preferably, the fastening elements 24 are not superimposed with the closure 23.

At the lower part of the rear, the vest 20 has a pocket 26 that can be closed by a closure 27 such as a slide-fastener or a self-gripping closure, snap buttons, etc.

In the case shown, the pocket has a substantially transverse form, but it can be made in any other form.

The pocket 26 is adapted to receive and house the bolero jacket 30 when the jacket is not used, particularly in dry weather. The pocket 26 could also be arranged in another zone of the vest, for example, in the front.

The bolero jacket 30 is made of a material that is water resistant and/or impermeable, and very light, such as polyamide, woven polyester, a fabric covered or coated with a breathable-impermeable membrane. The bolero jacket is very light, compact, and can be stored very easily in the pocket 26 without hindering the user's movements in any way, and without creating an excess weight or hindrance.

In fact, this bolero is a very short jacket that only covers the user's shoulders, arms, and chest. Consequently, it extends downwardly from the shoulders substantially to the lower limit of the chest, thereby being spaced above the lower end of the vest when the jacket is worn over the vest. As shown in FIGS. 1 and 3, the lower edge of the front of the jacket 30 is substantially horizontal when worn, thereby providing protection of the jacket substantially across the entirety of the chest.

The jacket 30 is provided at the front with an opening 33 that is closed by means of a slide-fastener, snap buttons, self-gripping device, etc.

The vest also has at the front, on both sides of its opening 33, a fastening mechanism 34 that is complementary to the fastening mechanism 24 of the vest 20 for attaching the jacket to the vest.

At the rear, as shown particularly in FIG. 5, no means for fastening the bolero jacket 30 to the vest 20 are provided, such that the bolero jacket does not hinder the evacuation of moisture at the upper back.

As can be easily understood, the garment according to the invention allows a good impermeability in the rain since the shoulders, arms and upper back and chest, i.e., those parts that are the most exposed, are completely protected, while offering the thermal insulation and ventilation desired in dry weather.

The present invention is not limited to the particular embodiments described hereinabove by way of non-limiting examples, but it encompasses all similar or equivalent embodiments.

What is claimed is:

1. A garment for protecting at least the upper portion of the body, said garment comprising:

a sleeveless vest covering a wearer's torso and extending over an area of the wearer's shoulders, when worn by the wearer, the vest comprising a thermally insulating and air permeable material;

on top of the area of the wearer's shoulders, the vest is made of a three-dimensional ventilated material, the three-dimensional ventilated material extending laterally along left and right sides of the garment along an area corresponding to the top of the area of the wearer's shoulders and downwardly through an area corresponding to the wearer's back;

a short-waisted jacket with sleeves, said jacket covering only an upper portion of the wearer's mid torso area, the jacket comprising a water resistant or impermeable material.

2. A garment according to claim 1, wherein:

the jacket extends from the area of the wearer's shoulders downwardly to substantially a lower limit of the wearer's chest.

3. A garment according to claim 1, wherein:

the jacket is provided with a fastening mechanism for fastening at a front of the vest.

4. A garment according to claim 1, wherein:

the vest comprises a thermal insulating zone reinforced in the area of the wearer's shoulders.

5. A garment according to claim 1, wherein:

the vest is made of an extensible material laminated to a jersey material.

6. A garment according to claim 5, wherein:

the extensible material is polyester.

7. A garment according to claim 1, wherein:

the vest comprises a pocket for housing the jacket.

8. A garment according to claim 1, wherein:

the vest comprises a pocket in a zone of the wearer's back for housing the jacket.

9. A garment according to claim 1, wherein:

the jacket has a front portion with a lower edge, said lower edge extending substantially horizontally when worn by the wearer.

10. A garment for protecting at least the upper portion of the body, said garment comprising:

a sleeveless vest covering a wearer's torso and extending over an area of the wearer's shoulders, when worn by the wearer, the vest comprising an air permeable material;

on top of the area of the wearer's shoulders, the vest is made of a three-dimensional ventilated material, the three-dimensional ventilated material extending laterally along left and right sides of the garment along an area corresponding to the top of the area of the wearer's shoulders and downwardly through an area corresponding to the wearer's back;

a short-waisted jacket with sleeves, said jacket covering only an upper portion of the wearer's mid torso area, including said three-dimensional ventilated material, the jacket comprising a water resistant or impermeable material;

at the top of the area of the wearer's shoulders, said material of said jacket in combination with said three-dimensional ventilated material providing thermal insulation within a thickness of said three-dimensional ventilated material.

11. A garment according to claim 10, wherein:

said three-dimensional ventilated material is an air-permeable material for ventilation and cooling when the jacket is not worn over the vest.

12. A garment comprising:

a vest comprising a front portion adapted to be positioned over a wearer's chest and a rear portion adapted to be positioned over the wearer's back, each of said front and rear portions of the vest extending from a lower edge to tops of left and right shoulders of the vest;

a jacket with sleeves covering an upper portion of the wearer's mid torso area, adapted to be worn over the vest, said jacket having a lower edge spaced above the lower end of the vest, when the jacket is worn over the vest;

said vest having a three-dimensional material zone, said three-dimensional material zone having a lower rear edge spaced above the lower edge of the rear portion of the vest, the three-dimensional material zone extending upwardly over the wearer's upper back through the tops of the left and right shoulders of the vest;

said three-dimensional material zone being made of an air-permeable material for ventilation and cooling when the jacket is not worn over the vest;

a remainder of the vest, including a part of the front portion below the lower front edge of the three-dimensional material zone and a part of the rear portion below the lower rear edge of the three-dimensional material zone comprising a material different from the material of the three-dimensional material zone;

said jacket comprising a water-resistant and/or impermeable material.

13. A garment according to claim 12, wherein:

said jacket, when worn over said vest, is adapted to completely cover said three-dimensional material zone.

14. A garment according to claim 12, wherein:

said jacket is a short-waisted jacket having a lower edge positioned substantially at a lower end of the wearer's chest, when worn.

15. A garment according to claim 12, wherein:

said jacket comprises sleeves through which the wearer's arms are adapted to extend.

16. A garment according to claim 15, wherein:

said vest is sleeveless.

17. A garment according to claim 12, wherein:

the three-dimensional material zone for each of said left and right shoulders of the vest has a front lower edge below the tops of the left and right shoulders of the vest.

18. A garment according to claim 12, wherein:

said material different from the material of the three-dimensional material zone is a thermally insulating fabric.

19. A garment according to claim 12, wherein:

said material different from the material of the three-dimensional material zone is an extensible material laminated to a jersey material.

20. A garment according to claim 12, wherein:

said material different from the material of the three-dimensional material zone is a polyester material.

21. A garment according to claim 1, wherein:

the three-dimensional ventilated material extends through a substantial portion of the top of the area of the wearer's shoulders.

22. A garment according to claim 1, wherein:

the three-dimensional ventilated material provides a thermal insulating zone.

23. A garment according to claim 22, wherein:

the three-dimensional ventilated material extends laterally along left and right sides of the garment over the top of the area of the wearer's shoulders and downwardly through an area of the wearer's back and downwardly through an area of a front of the wearer.

24. A garment according to claim 1, wherein:

said three-dimensional ventilated material has a lower rear edge spaced above a lower edge of a rear portion of the vest, the three-dimensional ventilated material extending upwardly over the wearer's upper back through tops of the left and right shoulders of the vest.

25. A garment according to claim 1, wherein:

the jacket has a back;

the three-dimensional material extends throughout a majority of the entirety of the back of the jacket.

26. A garment according to claim 1, wherein:

the jacket has a back having a lower edge;

the three-dimensional material extends downwardly to proximate the lower edge of the back of the jacket.

27. A garment according to claim 10, wherein:

the jacket has a back;

the three-dimensional material extends throughout a majority of the entirety of the back of the jacket.

28. A garment according to claim 10, wherein:

the jacket has a back having a lower edge;

the three-dimensional material extends downwardly to proximate the lower edge of the back of the jacket.

29. A garment according to claim 12, wherein:

the jacket has a back;

the three-dimensional material extends throughout a majority of the entirety of the back of the jacket.

30. A garment according to claim 12, wherein:

the jacket has a back having a lower edge;

the three-dimensional material extends downwardly to proximate the lower edge of the back of the jacket.

* * * * *